United States Patent [19]

Cherbland

[11] 4,237,697

[45] Dec. 9, 1980

[54] APPARATUS FOR ICING OR FREEZING OR FROSTING CONTAINERS OR HOLLOW BODIES, MORE PARTICULARLY DRINKING-GLASSES

[76] Inventor: Georges Cherbland, 5 place Maréchal Foch, 42100 Saint Etienne-Loire, France

[21] Appl. No.: 20,952

[22] Filed: Mar. 15, 1979

[30] Foreign Application Priority Data

Mar. 22, 1978 [FR] France ..... 78 09176
Dec. 20, 1978 [FR] France ..... 78 36590

[51] Int. Cl.[3] ..... F25D 3/00
[52] U.S. Cl. ..... 62/293; 62/514 R
[58] Field of Search ..... 62/62, 293, 514 R

[56] References Cited

U.S. PATENT DOCUMENTS

| | | | |
|---|---|---|---|
| 3,000,195 | 9/1961 | Federighi | 62/373 |
| 3,001,374 | 9/1961 | Hutton, Jr. | 62/514 R |
| 3,373,579 | 3/1968 | Federighi | 62/293 |
| 3,373,580 | 3/1968 | Federighi | 62/293 |
| 3,383,879 | 5/1968 | Tice | 62/293 |
| 3,407,624 | 10/1968 | Taylor | 62/293 |
| 3,431,749 | 3/1969 | Bounds et al. | 62/293 |
| 3,595,030 | 7/1971 | Roslonski | 62/514 R |
| 3,602,008 | 8/1971 | Kelley | 62/293 |
| 3,668,888 | 6/1972 | Roslonski | 62/293 |

*Primary Examiner*—Ronald C. Capossela
*Attorney, Agent, or Firm*—Haseltine and Lake

[57] ABSTRACT

Apparatus for icing, freezing or frosting containers such as drinking glasses comprising a tank containing liquefied gas under pressure which is supplied through a valve and a coiled capillary conduit to a nozzle which sprays the liquefied gas into the interior of the drinking glass. A displaceable receiver plate is adapted for placement of the glass thereon and, in response to pressure applied to the glass, the receiver plate is displaced to open the valve which releases the liquefied gas from the tank into the coiled capillary conduit and, then, from the nozzle into the interior of the glass. The coil configuration of the capillary conduit provides resilience thereof and allows the same to undergo deformation as the receiver plate is displaced. The capillary conduit also serves to convey the liquefied gas along an elongated path to provide heat exchange with the ambient atmosphere, pressure reduction of the liquefied gas and a time lag so that, at discharge from the nozzle the liquefied gas is in an ideal liquid-gaseous state.

14 Claims, 11 Drawing Figures

APPARATUS FOR ICING OR FREEZING OR FROSTING CONTAINERS OR HOLLOW BODIES, MORE PARTICULARLY DRINKING-GLASSES

FIELD OF THE INVENTION

This invention relates to an apparatus for icing or freezing or frosting containers or hollow bodies, more particularly drinking-glasses.

BACKGROUND AND SUMMARY OF THE INVENTION

An object of the invention is to provide apparatus for the formation of ice, frost or rime inside various containers or hollow bodies, more particularly drinking-glasses. For this purpose, it has been contemplated to use the principle of the release and spraying of a gas in a liqid state which is maintained in this condition in a bottle or tank by means of a compression.

In accordance with a first characteristic, the apparatus includes a bottle or tank containing, under pressure therein, a gas in the liquid state which is expelled by means of a dipping tube or by turning over the bottle or by any other means allowing the 100% liquid state, through a valve, the liquid being held at the bottom of the bottle by the gas formed within the unfilled part of said bottle; the gas in the liquid state being released after actuating a closing tap by a nozzle means such as one or more capillaries having at a time the action of a lagging device, of a heat exchanger and of a reducing valve, and capable of causing the discharge in a final deal liquid-gaseous state into an expansion chamber formed by the inside walls of the container or hollow body disposed on a plate to cause hereby the internal cooling of the latter and the formation of the frost by reason of the settling of the vapours contained within the air on the external walls.

According to a further characteristic of an alternative embodiment, a profiled and squared support can be adapted directly beneath the plate of a bar by means of screw jacks, while the vertical boss thereof permits owing to its opening the free sliding of the stem of a mobile table which is returned to the upper position by a coil spring and receives directly the container to be frosted, the direct discharge of the gas into the nozzle or diffusing means being permitted by a valve integral with the support through an adjustable and swivelling lever, the upper end of the nozzle or diffusing means extending through the support and being coupled directly to the axial part of the mobile table provided with a gasket for the direct diffusion of the gas in a liquid-gazeous state into the container.

According to a further characteristic of the alternative embodiment, the distributing valve is established with a piston having at the end a closing ring for cooperation with an annular opening which is is in communication with the nozzle or diffusing means, said piston being returned automatically to the closing position by means of elastic washers.

According to a further characteristic of the alternative embodiment, the distributing valve is in communication with a manifold which is directly connected either to the gas supply bottle or to any safety and connected device.

According to a further characteristic of the alternative embodiment, the assembly of the profiled support together with the equipment thereof is enclosed by a housing body with at the bottom a discharge snout for the droplets of liquid, said housing body being secured by means of its collar to the lower part of the plate of the bar.

BRIEF DESCRIPTION OF THE DRAWINGS

The nature of the invention will be further explained by reference to the accompanying drawings, without however being limited by these drawings, in which.

DETAILED DESCRIPTION

Figure 1:
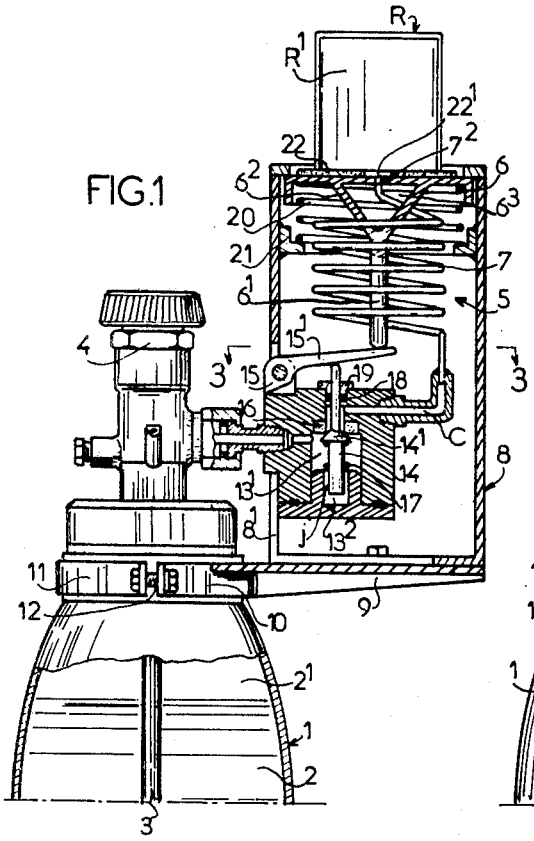
FIG. 1 is a part view in elevation and in section of the apparatus in accordance with the invention, in the non operative position.

The object of the invention now will be described more fully, but not restrictively, with reference to the examples illustrated by the Figures of the drawings.

The apparatus consists of a bottle 1 containing a gas in a liquid state 2, preferably 50 bars at 15° for carbon dioxide ($CO^2$).

This gas 2 in a liquid state is drawn from the bottom of the bottle 1 through a dipping tube 3 by turning over, or still by any system making it possible to carry in this same state the gas 2 up to a valve mounted on said bottle. It will be noted that the liquid 2 is maintained at the bottom of the bottle by the gas $2^1$ formed within the unfilled part of the bottle.

The gas is piped at the outlet of the closing tap 4 into a nozzle or diffusing means 5, simultaneously having the action of a lagging device, of a heat exchanger and of a reducing valve, to bring this gas from the liquid state 2 thereof to a final ideal state, into a release enclosure $R^1$ consisting of the internal walls of the container R, in order to cool the inside thereof and to produce a frost G on the external walls of this container. The container R is conveniently placed on a table 6 to which the nozzle or diffusing means 5 opens on.

Figure 5:
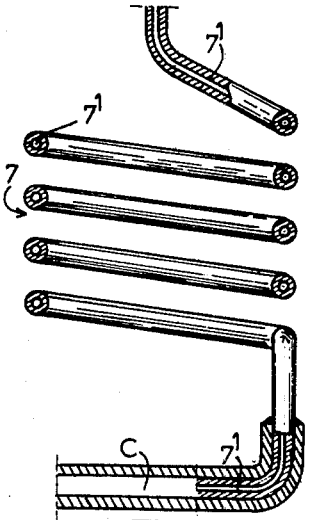
FIG. 5 is a view in section, on a larger scale, of the nozzle or diffusing means having at a time the action of a lagging device, of a heat exchanger and of a reducing valve.
Figure 6:
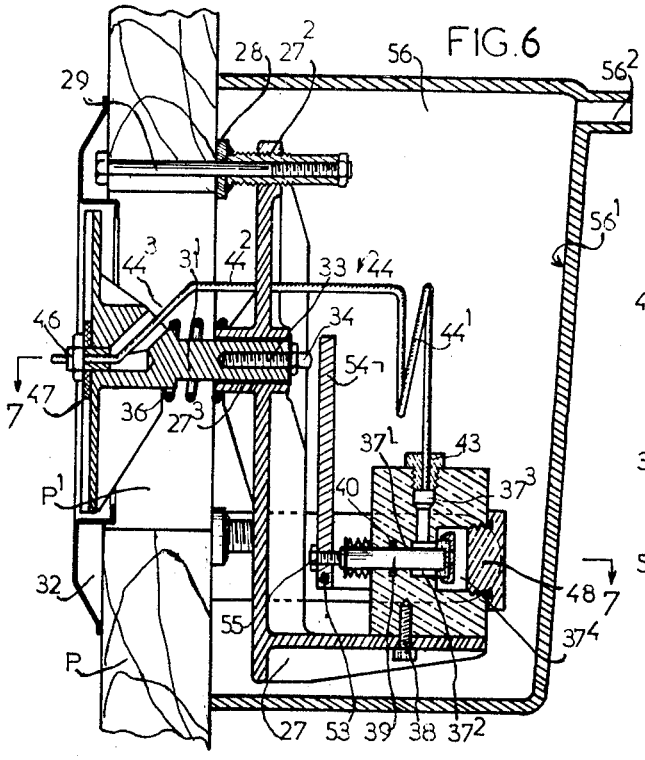
FIG. 6 is a view on a smaller scale a view in longitudinal section of an apparatus in accordance with the alternative embodiment.
Figure 8:
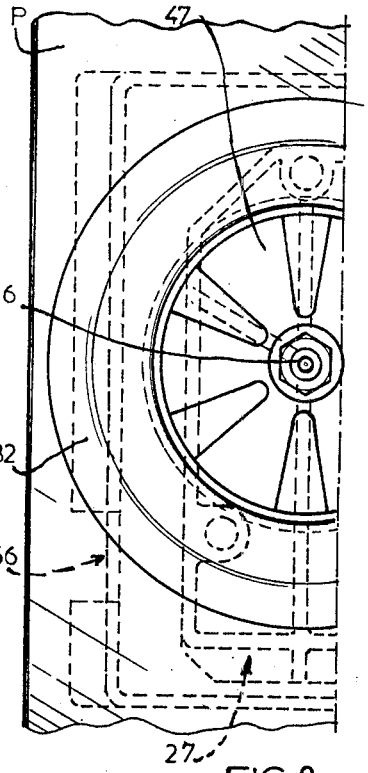
FIG. 8 is an external plan view corresponding to FIG. 6.
Figure 7:
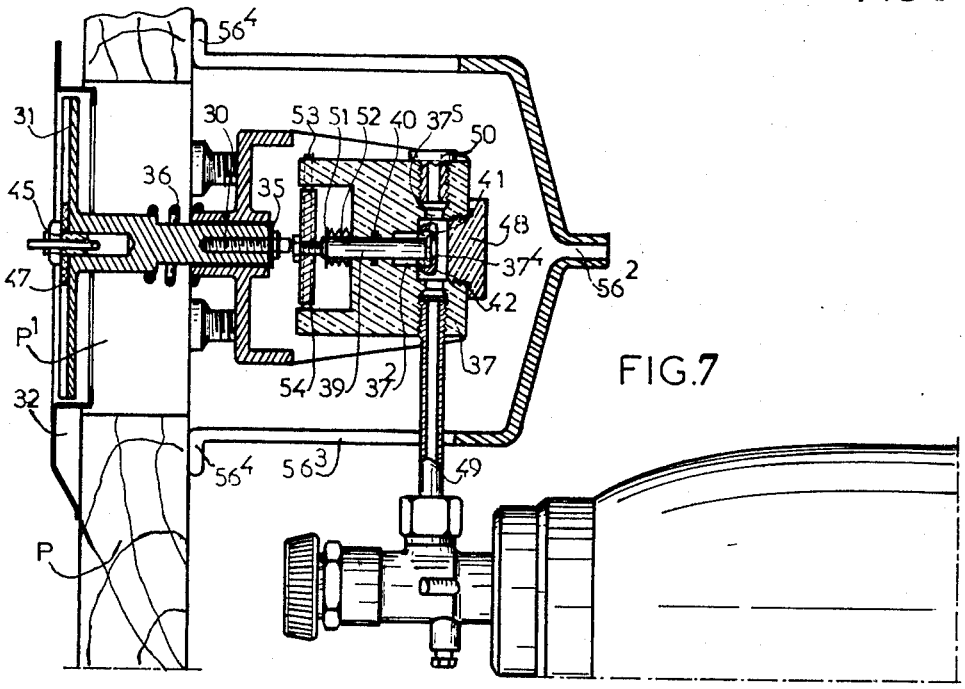
FIG. 7 is a view in cross-section taken along line 7—7 of FIG. 6.
Figure 9:
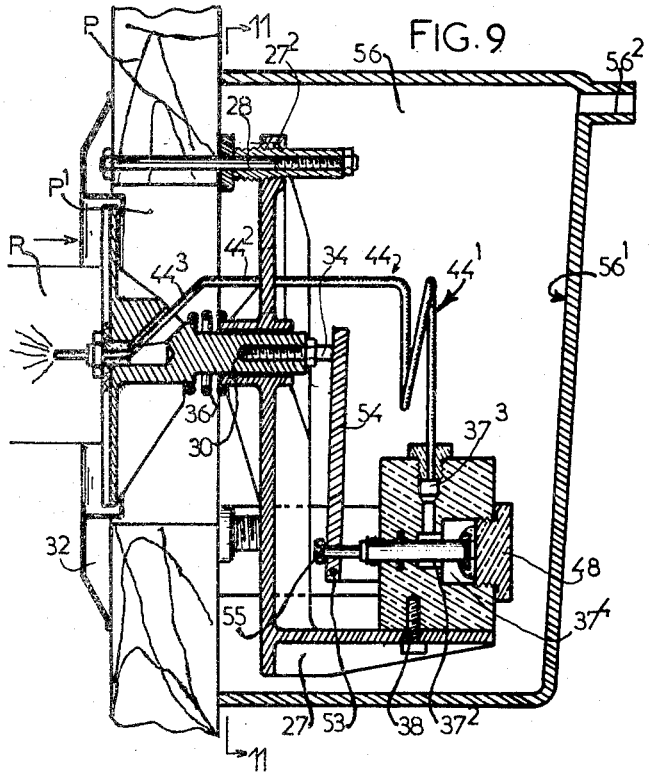
FIG. 9 is a longitudinal view in section similar to FIG. 6, but when the apparatus is operated.
Figure 11:
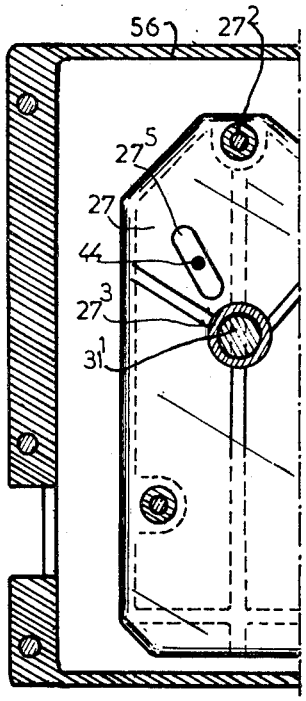
FIG. 11 is a plan view in section along the line 11—11 of FIG. 9.
Figure 10:
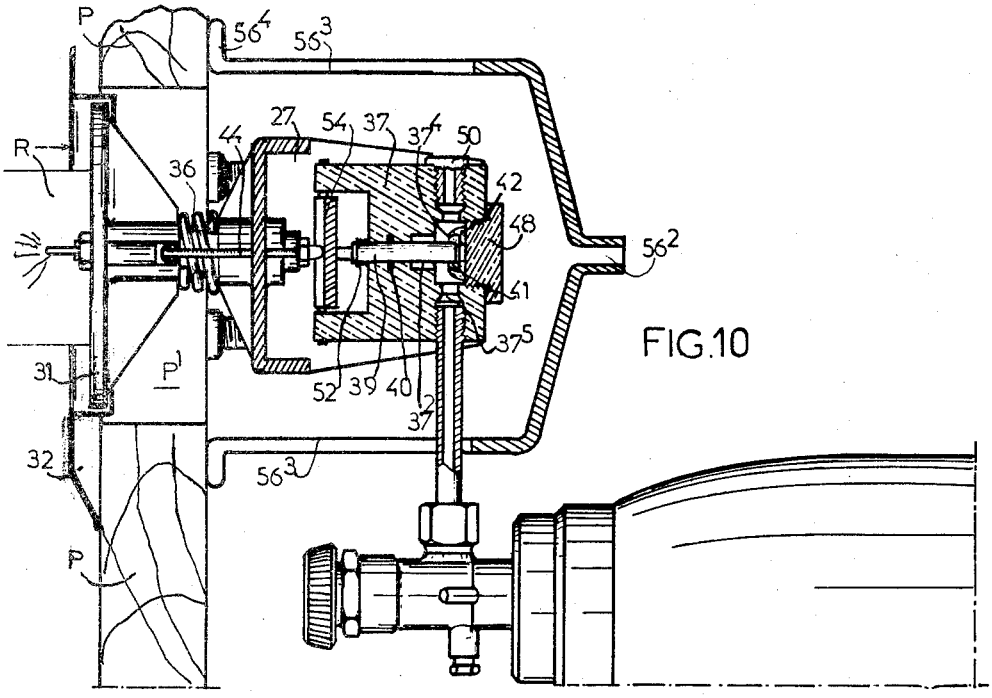
FIG. 10 is an external side view corresponding to FIG. 9.

This means 5, having concurrently the action of a lagging device, of a heat exchanger and of a reducing valve, consists of one or more capillaries $7^1$ forming preferably one or more pipe coils 7 conveniently dimensioned (FIG. 5) in accordance with the nature, the shape and the size of the container R. It is well understood that according to the applications and the gases to be used, the capillary may consist of a mere conduit receiving at the end a nozzle or diffusing means.

Figure 2:
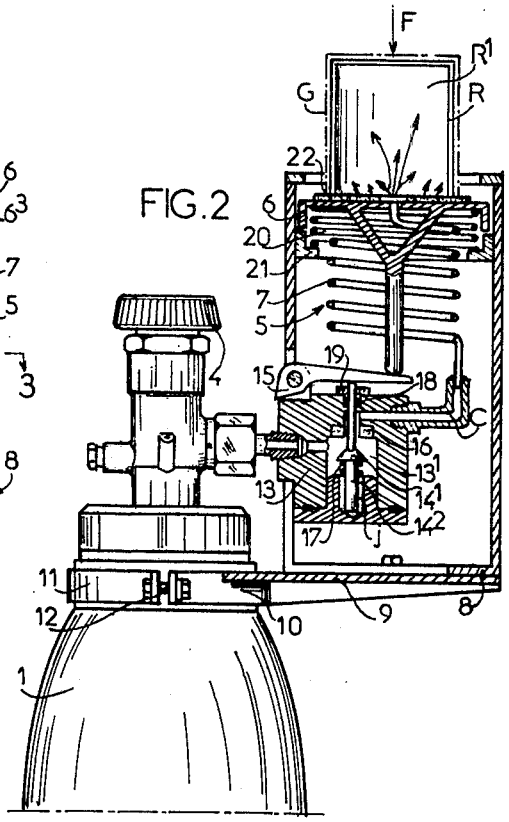
FIG. 2 is a view similar to FIG. 1, but when the apparatus is operated.
Figure 3:
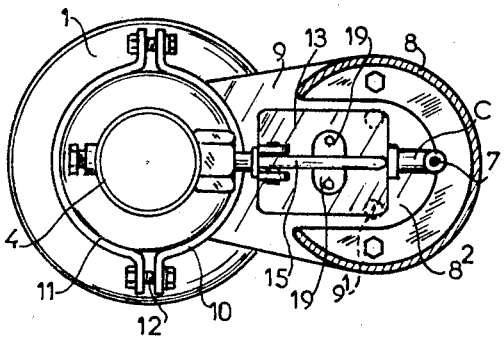
FIG. 3 is a view in section taken along line 3—3 in FIG. 1.

In accordance with the embodiment illustrated in FIGS. 1, 2 and 3, a casing 8 is mounted fixedly on a support 9 fixed in a protruding position within the upper part of bottle 1. As shown in FIG. 3, the support 9 can form directly, or detachably, a semi-circular flange 10 enclosing the upper part of bottle 1 and co-operating with a clamping collar 11. The connection of the support 9 with the collar 11 is effected, for instance, by means of bolts 12 or other assembling elements.

The casing 8 is of cylindrical shape, and has on a part of its height, opposite bottle 1, an opening $8^1$ which forms a cut-out $8^2$ at the bottom of said casing. The opening $8^1$ permits a valve 13 to be housed within the casing 8, said valve being shut off by the closing tap 4 of bottle 1. In the body of the valve 13, there is mounted vertically a piston 14 provided with a flap $14^1$ for opening or closing the valve 13 under the action of an actuating lever 15. It will be noted that the gases are stored within a chamber $13^1$ formed in the body of the valve, which results in maintaining the flap $14^1$ on the seat 16 thereof, more particularly made of Teflon, in combination with a return spring 17. Moreover, the rod $14^2$ of the piston is accommodated within a blind hole $13^2$ of the valve, with some clearance J for the self-centering of the flap $14^1$ on its seat 16.

Sealing is provided by a seal 18 mounted within the top part of the piston and maintained securely in abutment within its housing by a cap 19 forming a flange and engaged threadedly on the body of valve 13. This valve is connected to the capillary $7^1$ through a reserve chamber C permitting a storage of the gas prior to the passage thereof in the capillary $7^1$ for more smoothness in operation.

In the upper part of casing 8, the table 6, receiving the container R or hollow body to be frosted, is vertically mobile in said housing, while compressing a spring means 20, for the automatic resetting of the table. Spring means 20 abuts against a shoulder ring 21 fixed within the bore of casing 8. The vertical travel of the table 6 which is vertically abutted by any convenient means is limited by this ring 21 serving as a seat for spring means 20. The table 6 is provided axially, directly or detachably, with an axial finger $6^1$ which co-operates with the arm $15^1$ of the control lever 15 of valve 13.

It will be noted, in the embodiment in the drawing, that the axial finger $6^1$ is vertically offset relative to the center of table 6 by means of arms $6^2$ in order to leave a free space $6^3$ for the passage of the free end $7^2$ of the capillary $7^1$ opening at the center of said table, while being integral with the latter.

A seal 22 with more or less complete sealing is mounted on table 6, and has axially an opening $22^1$ for the normal passage of gas.

By reason of these arrangements, it will be understood that after having opened the closing tap 4 of bottle 1, the container or hollow body R to be iced, freezed or frosted is place upside down on table 6. The manual supporting action (arrow F FIG. 2) applied on the container R causes the table 6 to be moved vertically downwards until said table rests on the seat of the return spring 20 thereof. The lever 15 is therefore actuated by reason of the downward motion of table 6 through the finger $6^1$ thereof, and causes the opening of the valve by freeing from its resting seat, the flap $14^1$ of piston 14 to permit some quantity of gas under pressure 2 to escape through pipe coil 7 into the release enclosure $R^1$ of container R. There is an increase of the vapour degree during the passage through the capillary $7^1$ of the pipe coil. The stress is then released quickly while holding on the container R during the flow of the jet of gas in a liquid state. With the container R being cooled by the release of the carbon dioxide 2, the water vapour contained in the air becomes frosted at G on the external walls of the container.

Condensation liquid is discharged through openings $9^1$ formed in the support 9 of casing 8, to co-operate with the cut-out $8^2$ formed at the bottom of said casing (FIG. 3).

It will be noted that by reason of the downward motion of table 6, the return spring 20 thereof is compressed, and that the pipe coil 7 integral with said table 6 is also compressed thereby, however to a lesser extent, said pipe coil being made of any convenient material which would accommodate the gas to be used.

A device for the delayed upward and/or downward motion of table 6 may be provided, while remaining within the scope of the invention.

Figure 4:
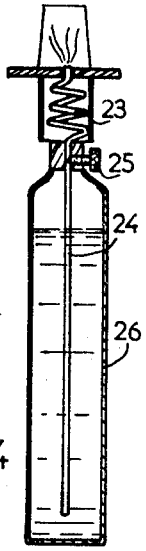
FIG. 4 is a front view illustrating schematically a simplified form of the apparatus.

As illustrated in FIG. 4, the pipe coil 23 can be connected directly to the dipping tube 24, the valve being omitted and the operation of the apparatus being controlled solely by the closing tap 25 of bottle 26.

Finally, the apparatus may receive a covering trim imparting to it any desired make up, or it can be integrated within a piece of furniture, while being equipped with a plurality of assemblies from the same bottle.

In accordance with the alternative embodiment illustrated in FIGS. 6, 7, 8, 9, 10 and 11, the apparatus is established substantially with a squared support 27 forming a plate at the upper part thereof and provided symmetrically within its thickness with tapped holes $27^2$ for cooperating threadingly with shouldered sockets 28 to form jacks, bolts 29 in these sockets extending through the thickness of the plate P of the bar to be equipped with the apparatus.

This arrangement makes it possible thereby to adapt the squared support 27 at a constant height relatively to the upper face of the plate P, irrespective of the thickness thereof.

The plate 27 is moreover provided with a boss $27^3$ disposed vertically and axially and drilled for the engagement of a bushing 30 in which the cylindrical and axial shank $31^1$ of a mobile table 31 is freely slidable, the upper part of the latter, preferably of circular shape, emerging from an opening $P^1$ formed within the thickness of plate P. A profiled edge 32, forming a cover for the bolt heads 29, is moreover fixed on said plate P in order to enclose and to protect vertically the upper part of the mobile table 31.

The lower end of the shank $31^1$ of the mobile table 31 is perforated for screwing therein a threaded finger 33 which is adjustable in the longitudinal position in order to co-operate in abutment with the end of the control lever of the valve. This threaded finger 33 is interlocked after adjustment by means of a nut 34 the inset washer of which 35, abutting on the end of shank $31^1$, protrudes peripherially stand opposite to the end of the boss $27^3$ in order to limit vertically the upward travel of the mobile table 31.

A coil spring 36 enclosing the shank $31^1$ is interposed between a shoulder of the latter and the upper end of boss $27^3$ to provide the permanent return of the mobile table 31 upwardly.

The reinforced vertical leg of the squared support 27 permits the positioning and the abutment of the parallelepiped body of the distribution valve secured by screws 38.

This body 37 has vertically a bore 37[1] in which a cylindrical piston 39 is moved slidably and co-operates upwards with a seal 40 located in a circular groove established within the bore 37[1]. The piston 39, at the lower end thereof, receives a peripheral flap 41, preferably made of plastics, and maintained circularly by means of a ring 42 secured by constriction.

This flap 41 faces an annular chamber 37[2] formed at the end of the bore 37[1] in front of the periphery of the piston 39 and in communication with a transverse opening 37[3] in which there is secured, by means of a threaded ferrule 43, the end of the nozzle or diffusing means such as a capillary tube 44 with an opening in small diameter in the order of, for instance, 6 tenths of a millimeter, whereby the spraying in a final liquidgaseous state into the drinking glass or container is permitted by said opening.

For this purpose, this capillary tube 44 is wound or not at the bottom thereof to form at least a turn 44[1] of large diameter which is connected to a vertical leg 44[2] extending freely an oblong opening 27[5] of the squared support 25. This leg 44[2] is lengthened by an oblique part 44[3] crossing two openings in succession of the mobile table 31 to face at the end vertically and axially and to be fastened to the upper part of said table 31. For this purpose, a split bushing 45 through which the end of the capillary tube 44 extends, can be clamped in position by means of a nut 46 and can also maintain a table seal 47 of recessed flexible material in the form of a plurality of circular sectors.

Above the peripheral flap 41, the body 37 of the valve forms a cylindrical chamber 37[4] closed at the bottom thereof by a plug 48 and in which two opposite apertures 37[5] open transversely and are respectively threaded for the connection of a manifold 49 for the inlet of the gas in a liquid state. This manifold 49 is connected to any safety and connection means leading to one or more gas supply bottles placed in any suitable location. It will be apparent that one side of aperture 37[5] is used. The opposite side is closed by a plug 50.

The projecting upper part of piston 39 receives a washer 51 engaged elastically within a corresponding groove and upholding a plurality of elastic washers 52 of the "Belleville" type placed in superposition and interposed between said washer 51 and the upper end of the body 37 so that the flap 41 is permanently returned in the closing position in front of the annular chamber 37[2]. The body 37 of the valve forms a yoke at the upper part thereof for the engagement by means of its cheeks of a hinged cross pin 53 of a control lever 54 the opposite end of which facts the threaded finger 33 integral with the shank 31[1] of the mobile table 31. An adjusting finger 55 screw threaded within the thickness of lever 54 co-operates in abutment with the upper end of piston 39.

By reason of these arrangements, it will be understood that the container R or hollow body to be iced, freezed or frosted is placed upside down on the table joint 47, while a manual and downward stress is exerted on the latter to cause the mobile table 31 to be moved downwardly and to actuate, on the one hand, the capillary tube 44 by bringing the turn 44[1] thereof, closer together which permits this distorsion, and on the other hand, the free end of the control lever 54, by means of the threaded finger 33, for causing this lever to be pivoted downwardly.

The piston 39 is therefore actuated by the finger 55, and the flap 41 is disengaged from the annular chamber 37[2] of the body 37 to permit thereby the free passage of the gas in a liquid state, which comes from the manifold 49 directly into the capillary tube 44.

The latter permits directly, without the intermediary of any capacity forming reserve chamber, the quick change from the liquid state to a final state of liquid-gaseous spraying into the enclosure formed by the inside of container R, such as a drinking glass placed upside down on the table joint 47.

It will be noted that the liquid-gaseous mixture obtained at the outlet of the capillary tube 44 can be extremely varied taking into account the nature of the container, the brittleness of the same and also the ambient temperature of the room and of said container.

Consequently, the capillary tube 44 can be of any convenient length, with or without a part or total winding in the form of a pipe coil, and adapted as the case may be.

This apparatus as described is completed by a receptacle housing 56 enclosing the assembly of the squared support 27 together with the equipment thereof, forming at its bottom a profiled and slanting base 56[1] leading to a discharge chute 56[2] for droplets of liquid that could flow from the mobile table 31. Moreover, this housing 56 has on its lateral sides two opposite slots 56[3] for the free passage of the manifold 49 when mounting and securing the same on the lower face of the plate P of the bar. For this purpose, a square edge 56[4] established on the upper parts of the lateral sides permits, by means of the holes thereof, the fastening of said housing 56 by means of screws or otherwise.

The advantages will be readily apparent from the description, and include more particularly:

the low gas consumption;

the spraying of the gas-liquid mixture at an ideal temperature avoiding the breaking of glass;

the uniform distribution of the mixture inside the enclosure in order to obtain a freezing on the entire drinking glass or for some other application;

the possibility for the user to modify the length of the capillary tube 17, whereby said tube can be provided for this purpose, as the case may be, with marks or reference numbers corresponding to characteristics of use.

I claim:

1. Apparatus for icing, freezing or frosting containers or hollow bodies, more particularly drinking glasses, said apparatus comprising a tank with closing means containing a gas in a liquid state under pressure, means including a receiver plate for abutment of at least one drinking glass thereagainst, a spraying nozzle positioned within said receiver plate for facing into the interior of said drinking glass when the latter is abutted on the receiver plate, valve means for controlling flow of said gas from said tank to said nozzle, means for controlling said valve means in response to the abutment of said glass with the receiver plate thereby for controlling the distribution of the gas to said nozzle and to the glass to be frosted, and means connecting said nozzle and to the glass to be frosted, and means connecting said nozzle to said valve means for conveying the liquefied gas from said tank to the nozzle and thus to the glass in the receiver plate, said means comprising a capillary conduit to convey said liquefied gas along an elogated path to provide heat exchange with the ambient atmosphere, pressure reduction of the liquefied gas and a time lag so that at discharge from the nozzle the liquefied gas is in a liquid-gaseous state and flows into the glass to lower the temperature therein and produce the homogeneous formation of frost on the outside wall of the glass from water vapor in the ambient air.

2. Apparatus as claimed in claim 1 wherein said receiver plate is displaceable under pressure applied thereto by said glass, said nozzle being secured to said receiver plate, said connecting means being constructed as a resilient means for permitting relative movement of said nozzle with respect to said valve means during movement of said receiver plate.

3. Apparatus as claimed in claim 2 wherein said capillary conduit is wound with at least one coil to form said resilient means and provide axial deformability in the direction of displacement of said receiver plate.

4. Apparatus as claimed in claim 3 comprising a support on said tank, a casing secured to said support and supporting said valve means, said valve means being directly connected to said capillary conduit, said conduit having a free end which supports said nozzle and which opens through said receiver plate, said receiver plate being mounted for free sliding movement relative to said casing, an axial finger integral with said plate, spring means acting on said plate to urge the same to an initial position, said valve means comprising a valve with a flap, and a control lever engaging said valve, said finger engaging said control lever so that when the receiver plate is displaced by application of pressure to the glass said valve is opened and the liquefied gas is distributed in liquid state through the capillary conduit to the nozzle and discharged within the glass in said liquid-gaseous state.

5. Apparatus as claimed in claim 4 comprising a tight seal mounted on said receiver plate and having an opening for normal passage of the gas in the liquid-gaseous state at the outlet from the nozzle.

6. Apparatus as claimed in claim 5 wherein said casing has a bottom provided with at least one opening for the discharge of condensation liquid.

7. Apparatus as claimed in claim 6 comprising means acting on said piston to brake the travel thereof in both directions to provide a time-delay in the motion of said piston, and therefore in the flow of the liquefied gas from the tank.

8. Apparatus as claimed in claim 7, wherein said piston of the valve includes a flap which in the closed position is maintained against its seat by the pressure of the gases stored in a chamber in the body of the valve, and by a return spring which also causes abutment of the piston with the control lever, said control lever being pivotally hinged at one end and in contact with said finger of the plate at the other end, said piston having a rod guided in a blind hole with play for self-centering of the flap on the seat thereof.

9. Apparatus as claimed in claim 2 comprising a profiled and squared support, and means for fitting said support directly above a bar counter including adjustable screw jacks independent of said tank, said support including a vertical boss disposed coaxially with an opening provided in said receiver and permitting free sliding of said table and a coil spring acting on said plate to oppose travel thereof.

10. Apparatus as claimed in claim 9 wherein said valve means comprises a distributing valve integral with said support, a lever acting on said valve to control the same, an adjustable finger secured to said table to act on said lever and produce discharge of the liquefied gas directly into said connecting means, said connecting means comprising said capillary conduit having an upper end which is coupled to said table and to said nozzle by an abutting joint for direct spraying of the liquefied gas in a liquid-gaseous state.

11. Apparatus as claimed in claim 10 wherein said distributing valve includes a sliding piston having at one end a closing flap-ring for abutment in front of an annular opening in communication directly with the capillary conduit of said connecting means, and elastic washer means for returning said piston automatically to an upper closed position.

12. Apparatus as claimed in claim 11 wherein said distributing valve is in communication through a lower chamber disposed beneath the flap-ring with a manifold leading to said tank.

13. Apparatus as claimed in claim 12 comprising a housing enclosing said profiled support and the associated equipment, said housing having a profiled and slanting bottom provided with a discharge chute for liquid which could possibly flow from said table, said housing having at the upper part thereof a collar for engaging the lower surface of said bar counter.

14. Apparatus as claimed in claim 13 wherein said capillary conduit includes at last a portion of one winding in the form of a pipe coil, said conduit being coupled at the ends thereof to said table and to said distributing valve.

* * * * *